United States Patent [19]

Hagewood et al.

[11] Patent Number: 4,916,783

[45] Date of Patent: Apr. 17, 1990

[54] APPARATUS FOR CONTROLLED BRAKING OF A DRIVEN YARN ENGAGING ROLL

[75] Inventors: John F. Hagewood, Matthews; Julius Darigo, Charlotte; Bruce S. McCoy, Monroe; John M. Single, Matthews, all of N.C.

[73] Assignee: McCoy-Ellison, Inc., Monroe, N.C.

[21] Appl. No.: 257,052

[22] Filed: Oct. 13, 1988

[51] Int. Cl.[4] ..... D02H 13/12

[52] U.S. Cl. ..... 28/172; 28/245

[58] Field of Search ..... 28/185, 187, 172, 271, 28/241, 242, 245; 264/40.1

[56] References Cited

U.S. PATENT DOCUMENTS

| | | | |
|---|---|---|---|
| 4,074,404 | 2/1978 | Schenk | 28/185 |
| 4,407,767 | 10/1983 | Seaborn | 264/40.1 |
| 4,501,710 | 2/1985 | Abbott et al. | 264/40.1 |
| 4,573,245 | 3/1986 | Pfister | 28/187 |
| 4,669,159 | 6/1987 | Bogucki-Land | 28/185 |

OTHER PUBLICATIONS

"Draw-Warping-Mayer Warp Drawing Machine Developed Further"; *Man-Made Fiber Year Book (CTI) 1986*, pp. 104-105.

"Warp Preparation-Production of Warps from Flat Synthetic Filament Yarns"; Textile Month, May, 1984, pp. 48-50.

"Draw-Warping-Effect of Machine Downtimes in Draw-Warping on Yarn Properties"; *Man-Made Fiber Year Book (CTI) 1987*, pp. 108-119.

"Draw-Warping—Draw-Warping and Draw-Warp--Sizing System for POY and Undrawn Yarns"; *Man--Made Fiber Year Book (CTI) 1986*, pp. 108-110.

"Draw-Warping-Draw Warping: the State of the Art"; *Man-Made Fiber Yearbook (CTI) 1986*, pp. 106-107.

"New Systems for Draw-Beaming POY Yarns"; *Fiber World*, Sep. 1984, pp. 61-68.

*Primary Examiner*—Werner H. Schoeder
*Assistant Examiner*—Bradley DeSandro
*Attorney, Agent, or Firm*—Shefte, Pinckney & Sawyer

[57] ABSTRACT

In a textile draw warping system having independently driven sets of draw rolls and an independently driven warp beam, synchronous braking of the driven components is controlled by individual pneumatic brakes at each driven component operated by a central programmable logic control system to brake the driven components at respective rates of deceleration preset to maintain constant speed ratios between the driven components during braking. Auxiliary control of dynamic braking and driving of the several drive motors corrects deviations in the driven components' predetermined rates of deceleration.

8 Claims, 3 Drawing Sheets

APPARATUS FOR CONTROLLED BRAKING OF A DRIVEN YARN ENGAGING ROLL

BACKGROUND OF THE INVENTION

The present invention relates generally to an apparatus for controlled braking of a driven yarn engaging roll and, more particularly, to such an apparatus specifically adapted for controlled braking of independently driven rolls and a warp beam in a textile draw-warping system.

In virtually all systems involving the handling of a traveling yarn and similar strand-like materials by means of one or more driven guide rolls and/or a winding drum and the like, it is important when stoppage of the system becomes necessary that the rate of deceleration of the driven component or components be such as to not adversely affect the maintenance of some degree of uniformity in the tensioning of the yarn or other strand-like material. In many circumstances, it is necessary or highly desirable in such systems to effect stoppage of the traveling movement of the yarn or other strand-like material rapidly, e.g., when a breakage of the traveling material requires repair or when the driven components are operated at high speeds or otherwise have significant inertia, and accordingly it is common to brake the driven components to a standstill. Such factors are of particular concern in systems having plural independently driven components engaging the traveling yarn or strand-like material, especially if the driven components are operated at differing normal driven speeds or have differing inertial properties, which necessitate that the driven components be decelerated, whether by braking or otherwise, in synchronism with one another to avoid undesirable increases or decreases in the tension in the traveling yarn or strand material between the driven components.

For example, in a textile draw-warping system, a plurality of continuous synthetic filament yarns are fed in parallel side-by-side relationship through a drawing unit wherein the yarns are subjected to a drawing operation between spaced sets of drive rolls driven at differing speeds and subsequently the yarns are delivered to a warp beaming machine whereat the yarns are wound side-by side onto a warp beam. While the traveling speed of the yarns is desirably maintained substantially constant and, in turn, the respective driven speeds of the guide rolls in the drawing unit are likewise maintained substantially constant during normal operation, the driven axial speed of the warp beam must be progressively decreased over the course of the winding operation to maintain its peripheral surface speed, i.e. its yarn take-up speed, substantially constant as the progressive winding of the yarns about the warp beam gradually increases its effective diameter. As will also be understood, the overall mass of the warp beam and the attendant inertia thereof increases in relation to the increasing effective diameter of the beam. Accordingly, when stoppage of a draw-warping system is necessary, dramatic increases or decreases in the yarn tension are likely to result either or both between the differentially driven guide rolls in the drawing unit and between the downstream drawing unit guide rolls and the warp beam, which may result in yarn breakage or other yarn damage, unless the drawing unit guide rolls and the warp beam are stopped synchronously with one another.

Conventionally, compatible braking of the differentially driven drawing unit guide rolls and the warp beam is known to be accomplished in two possible manners. First, electrically-operated brakes may be applied to the driven components which are mechanically interconnected through a common gear box for synchronized braking, In another system, the respective drive motors for the driven components are braked dynamically in synchronism. While generally effective for their intended purpose, these conventional braking systems have several disadvantages. In the first type of braking system, the use of a gear train mechanically interconnecting the driven members undesirably increases the complexity and cost of the overall apparatus. With respect to dynamic braking systems, the maximum rate at which a drive motor can be braked dynamically is limited by the power rating of the motor and, thus, drive motors of relatively high power ratings must be utilized in order to achieve effective dynamic braking and, even so, the maximum practical operating speed of the draw-warping system is still limited by the dynamic braking ability of the drive motors utilized. Further, in typical dynamic braking systems, no means is provided for maintaining the braking rates of the individual drive motors in synchronism in the event undesirable deviations in braking occur.

SUMMARY OF THE INVENTION

It is accordingly an object of the present invention to provide an apparatus by which the braking of a driven yarn engaging roll may be controlled in a predetermined manner. Another object of the present invention is to provide such a controlled braking apparatus wherein deviations from the desired rate of braking are detected and corrected. It is a further object of the present invention to provide such a controlled braking apparatus capable of braking independently driven rolls synchronously with one another, particularly in a textile draw-warping system.

As used herein, the term "yarn" is intended to generically encompass substantially any continuous length textile material, e.g., yarns per be, threads, continuous length filaments, etc.

Briefly summarized, the braking apparatus of the present invention basically includes a device for applying a variable braking force to the driven yarn engaging roll, a sensing device for detecting the speed of the roll, and an arrangement for controlling operation of the braking device according to a predetermined program, preferably, for example, through a programmable logic controller. The braking program arrangement includes a primary control program for controlling the variable braking device for decelerating the driven roll in a predetermined relationship of decreasing roll speed to elapsed braking time, with an auxiliary control program being responsive to the roll speed sensing device to actuate either dynamic braking or driving of the driven roll in conjunction with the variable braking device to correct deviations in the detected speed of the roll from its predetermined speed-to-time relationship.

Preferably, the braking device is a fluid-actuated brake such as a conventional pneumatic brake, having an associated adjustable regulator valve or the like capable of supplying a pressurized operating fluid, e.g. air, to the fluid-actuated brake at a selectively variable pressure for generation of a correspondingly variable braking force. The primary control program of the braking program arrangement controls operation of the adjustable valve for controlling the pressure at which the pressurized operating fluid is supplied to the brake in order to achieve control of the deceleration of the roll at the predetermined speed-to-time relationship. The braking control program is also preferably adapted for adjusting the predetermined speed-to-time relationship of the roll as a function of its driven speed detected by the sensing device prior to braking actuation. The roll speed sensing device may advantageously be a tachometer associated with the roll drive motor. The valve is preferably adjustable electrically in relation to varying of the operating voltage supply or the electrical current supply to the valve.

In embodiments of the braking apparatus wherein the driven roll to be braked is arranged for winding of yarn thereabout, another sensing device is provided for detecting the wound diameter of yarn on the roll and the braking program arrangement is adapted for adjusting the predetermined speed-to-time relationship according to the total mass of the roll and the yarn wound thereabout as a function of the detected wound diameter of yarn on the roll. The diameter sensing device may advantageously be an ultrasonic device for measuring the radial depth of yarn windings on the roll to enable extrapolation therefrom of the total effective wound diameter of the roll.

In embodiments wherein a second yarn engaging roll driven by a second drive motor is arranged for engaging the yarn in sequence with the first-mentioned roll, a separate fluid-actuated brake is provided for the second roll with a separate associated adjustable regulator valve and a separate associated speed detecting device. The primary and auxiliary control programs are adapted to independently control braking of the second roll through the associated brake and, as necessary, through dynamic braking and/or driving of the drive motor to the second roll simultaneously with, and in a predetermined relation to, the braking of the first roll to maintain uniform tension in the yarn between the rolls.

For example, the braking apparatus of the present invention is preferably embodied in a textile draw warping system wherein a plurality of synthetic continuous filaments travel in sequence peripherally over a first set of guide rolls driven by a common drive motor and a second set of guide rolls driven by a separate common drive motor at a greater surface speed than the first set of rolls to achieve drawing of the filaments between the two sets of rolls, following which the filaments are wound about a warp beam in a warp beaming machine driven by a third drive motor. A separate fluid-actuated brake is provided for each of the guide rolls and also for the warp beam and a separate adjustable regulator valve is respectively associated with each brake. Likewise, individual speed detecting devices are associated with the three respective drive motors. The primary control program individually controls adjustment of each valve for controlling the fluid pressure supplied to each brake and, in turn, to control deceleration of each roll of the first set of rolls at a common speed-to-time relationship, to likewise control deceleration of each roll of the second set of rolls at their own respective speed-to-time relationship, and to control deceleration of the warp beam at its own speed-to-time relationship, the respective speed-to-time relationships being related to one another so as to maintain a predetermined ratio between the common speed of the first set of rolls, the common speed of the second set of rolls, and the warp beam speed during the braking process. The auxiliary control program is likewise independently responsive to the individual speed detecting devices to independently actuate either dynamic braking or driving of the respective drive motors, as necessary, to correct deviations from the predetermined speed-to-time relationships.

DESCRIPTION OF THE PREFERRED EMBODIMENT

Figure 1:
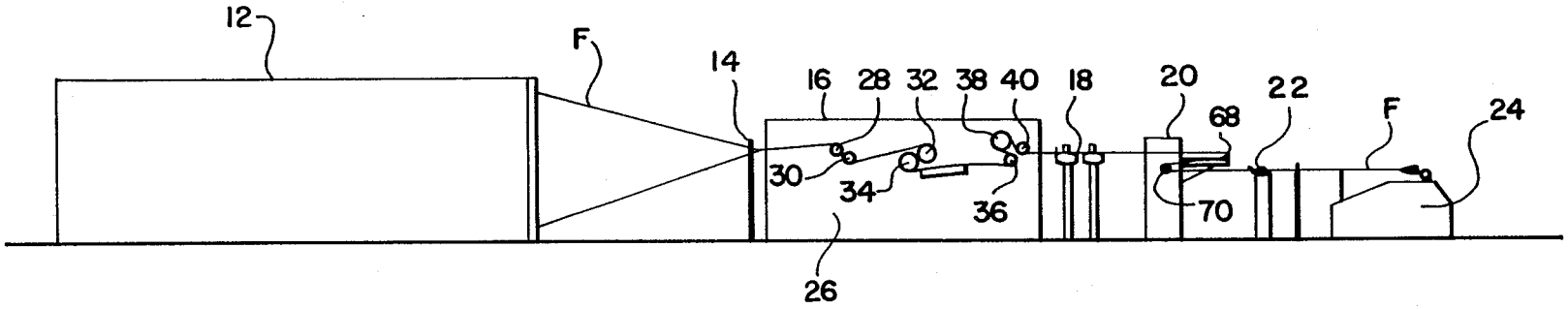
FIG. 1 is a schematic side elevational view of a draw-warping system of the type in which the braking apparatus of the present invention is preferably embodied.

Referring now to the accompanying drawings and initially to FIG. 1, a textile draw-warping system of the type in which the braking apparatus of the present invention may be incorporated is shown schematically in side elevation. Basically, the draw-warping system includes a creel, representatively indicated at 12, which supports a plurality of individual packages of partially oriented synthetic continuous filaments, such as polyester or nylon, which are fed as represented at F generally in side-by-side relationship through an eyeboard 14 to a drawing apparatus 16 and travel therefrom through a filament inspecting device 18, a tension controlling apparatus 20, and an oiling device 22, to a warp beaming machine 24, commonly referred to as a warper. While the braking apparatus of the present invention is herein illustrated and described in its preferred use for controlling braking of the driven roll components of the described draw-warping system, such description is only for purposes of illustration in order to provide an enabling disclosure of the best mode of the present invention. Those persons of skill in the art will readily recognize that the present braking apparatus is of a broad utility and is therefore susceptible of many other applications and embodiments whenever it is necessary or desirable to control braking of a driven yarn engaging or yarn winding roll.

Figure 2:
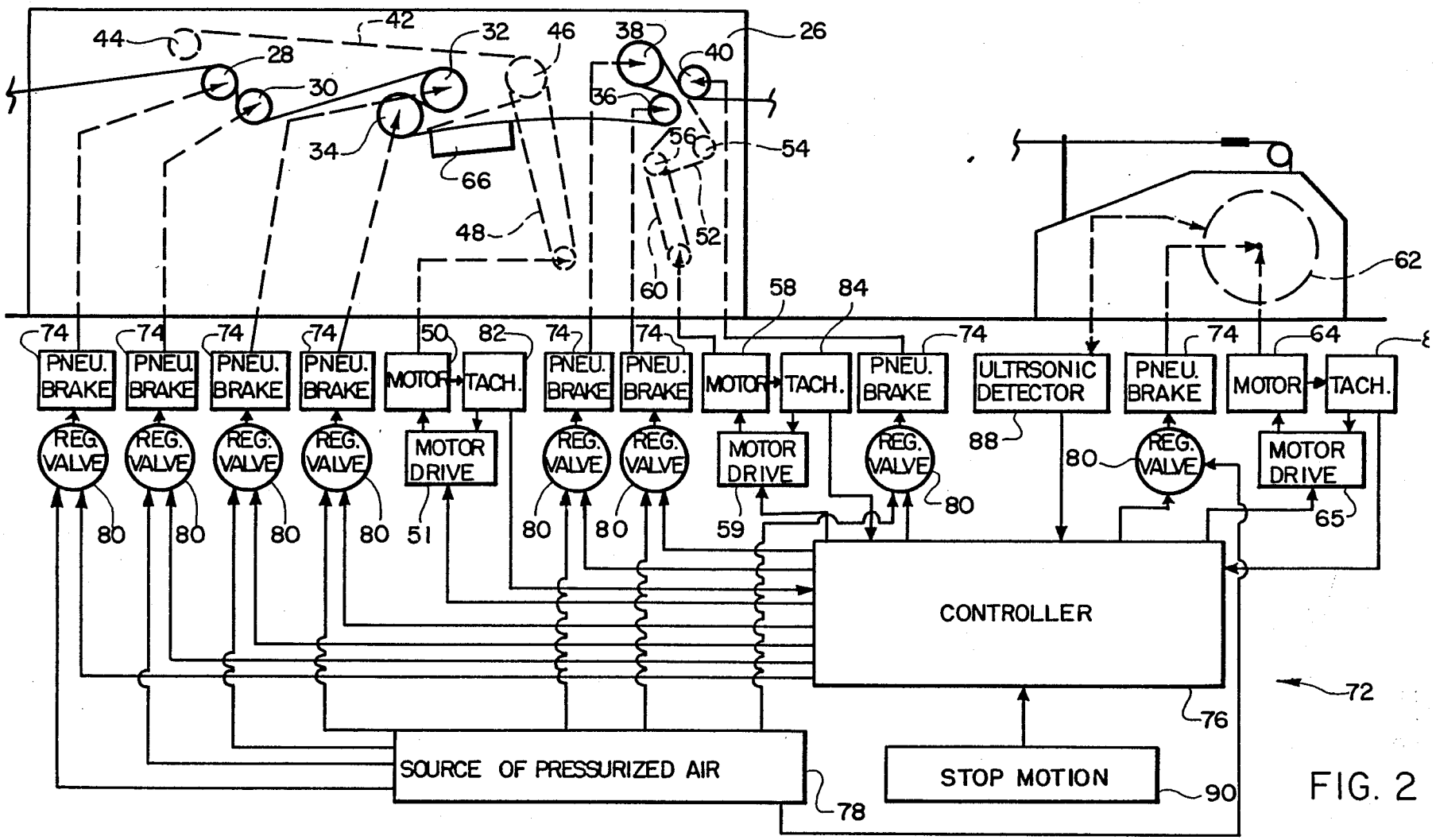
FIG. 2 is a schematic diagram of the braking apparatus of the present invention as incorporated in the draw-warping system of FIG. 1 for controlling braking of two sets of drawing rolls in its drawing unit and the warp beam in its warp beaming machine.

In the draw-warping system of FIG. 1, the drawing apparatus 16 includes a plurality of driven draw rolls and the warp beaming machine 24 supports a driven warp beam by which the filaments F are caused to travel through the draw-warping system. The specific construction of the drawing apparatus 16 is more fully described in co-pending U.S. patent application Ser. No. 212,214 filed June 27, 1988, entitled "Draw Warping Apparatus, issued Aug. 1, 1989, as U.S. Pat. No. 4,852,225," which is commonly assigned with the present invention to McCoy-Ellison, Inc., the disclosure of such application being incorporated herein by reference. Basically, the drawing apparatus 16 has an upstanding central frame 26 by which a series of draw rollers, including a feed roller 28, a swing roller 30, a pair of heated godet rollers 32, 34 and three take-up rollers 36, 38, 40 are rotatably supported to extend outwardly in cantilevered fashion from each opposite side of the frame 26 for training of the partially oriented filaments F in sequence peripherally about the rollers as shown. Within the interior of the frame 26, the feed roll 28, the swing roll 30 and the godet rolls 32, 34 are synchronously driven in common by an endless drive belt 42 trained in series about the interiorly mounted portion of such rolls as well as about an idler pulley 44 and a drive pulley 46 which, in turn, is driven through another drive belt 48 from a drive motor 50, as shown in Figure 2. Similarly, the take-up rolls 36, 38, 40 are synchronously driven in common by a drive belt 52 trained peripherally about each thereof and about an idler pulley 54 and a drive pulley 56 which, in turn, is driven by a drive motor 58 through another drive belt 60. A heated platen 66 is positioned for contact with the filaments F along the extend of their travel from the godet roll 34 to the first take-up roll 36 for heating the filaments F to a more elevated temperature sufficient to achieve crystallization of the filaments. The warp beaming machine 24, which may be of substantially any conventional construction, basically includes a warp beam 62 rotatably driven by a drive motor 64 for progressively winding the filaments F about the beam 62 in side-by-side relation.

Each of the drive motors 50, 58, 64 are conventional variable speed electric motors, control of which is provided through a respective associated electronic motor drive 51, 59, 65 to allow the draw rolls and the warp beam to be driven at compatible speeds for cooperatively transporting the filaments F through the draw warping system. In normal operation, the respective drive systems for the feed, swing and godet rolls 28, 30, 32, 34 and for the take-up rolls, 36, 38, 40 are selectively set to drive the take-up rolls at a predetermined greater surface speed than the feed, swing and godet rolls to cause the filaments F to be drawn longitudinally to a predetermined desired degree from the point at which the filaments leave contact with the godet roll 34 to the first take-up roll 36 as the platen 66 crystallizes, i.e. heat sets, the filaments F. The drive system for the warp beam 62 is controlled to maintain substantially the same surface speed for filament winding take-up as the surface speed of the take-up draw rolls 36, 38, 40 to maintain a desirable tension level within the filaments F between the drawing apparatus 16 and the warp beaming machine 24 without causing further drawing thereof. As will be understood, the drive motor 64 for the warp beam 62 is operated at a gradually reducing speed over the course of the winding operation to maintain the surface speed of the warp beam 62 substantially constant as its effective diameter progressively increases as the filaments F are wound thereabout.

The tension controlling apparatus 20 includes a pair of rotatable idler rolls 68, 70 extending outwardly in cantilevered fashion from each opposite side of the tension controlling apparatus 20 for training of the filaments F in sequence peripherally about the rolls 68, 70, the roll 68 being stationary and the roll 70 being biased away from the roll 68 for compensating for tension variations in the traveling filaments F occurring between the drawing apparatus 16 and the warp beaming machine 24, as more fully disclosed in a co-pending U.S. patent application Ser. No. 252,497, filed Sept. 30, 1988, entitiled "Apparatus for Controlling Tension in a Traveling Yarn" commonly assigned with the present invention to McCoy-Ellison, Inc., of Monroe, N.C., which application is also incorporated herein by reference.

As aforementioned, whenever it occasionally become necessary to stop the draw warping apparatus during its above-described normal operation, it is very important that the ratio between the differential surface speeds of the feed, swing and godet rolls 28, 30, 32, 34 and the take-up rolls, 36, 38, 40 and between the takeup rolls 36, 38, 40 and the warp beam 62 are maintained constant over the entire course of deceleration thereof to a standstill. It is also highly desirable that stoppage of the entire system be accomplished very rapidly, even when the draw warping system is operating at a very high filament traveling speed, e.g. between 500 and 1,000 yards per minute.

The braking apparatus of the present invention, generally indicated at 72 in FIG. 2, accomplishes these purposes by providing an individual pneumatically-operated braking device 74 at each driven draw roll 28-40 and also at the drive shaft of the warp beam 62 to provide a direct braking force to each driven component in a predetermined synchronized manner under the control of a suitable programmable logic control system 76, which actuates operation of the brakes 74 while also controlling the drive motors 50, 58, 64 to the driven components according to a predetermined braking program stored in memory in the controller 76.

Operating air under pressure is supplied independently to the individual pneumatic brakes 74 from any suitable centralized source of pressurized air, representatively indicated at 78, through a corresponding plurality of adjustable regulator valves 80 each associated with a respective one of the pneumatic brakes 74. The adjustability of the regulator valves 80 permits the operating air to be selectively supplied independently to each pneumatic brake 74 at varying air pressures to, in turn, enable each brake 74 to generate a correspondingly variable braking force on the respective draw roll or warp beam with which the brake 74 is associated. Pneumatically operated brakes and adjustable pneumatic regulator valves are well known and commercially available. Substantially any such conventional type of pneumatic brake and substantially any compatible conventional regulator valve may be utilized so long as they are capable cooperatively of generating variable braking forces within a suitable range for braking the draw rolls and warp beam. In a preferred embodiment of the present invention, each of the regulator valve is of a type which is operable electrically to deliver the operating air at a regulated pressure which is selectively variable as a function of variation of the operating input voltage or variation of the electrical current supplied to the valves. For this purpose, each regulator valve 80 is independently connected electrically to the microprocessor 76 for individual control of the operating input voltage supplied to the regulator valves 80 according to the predetermined braking program. Of course, those persons skilled in the art will recognize that various other types of braking devices and compatible controls therefore may also be utilized in accordance with the present invention.

Figure 3:
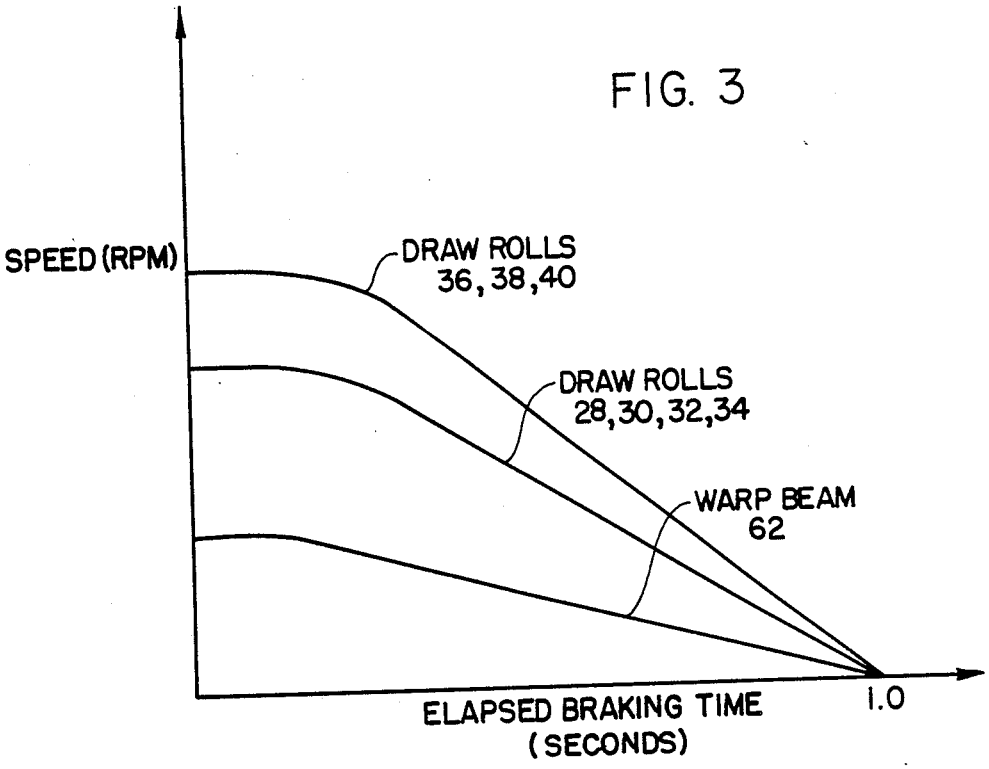
FIG. 3 is a graph representatively illustrating the respective relationships of decelerating speed against elapsed braking time for braking each set of drawing rolls and the warp beam of FIG. 2 in accordance with the present invention.

According to the present invention, upon stoppage of the draw warping system, each driven draw roll 28–40 and the warp beam 62 is to be braked to decelerate in a predetermined relationship of decreasing speed to elapsed braking time, with each of the commonly driven draw rolls 28, 30, 32, 34 being braked at the same speed-to-time relationship, with each of the commonly driven draw rolls 36, 38, 40 being likewise braked at a common predetermined speed-to-time relationship differing from that of the draw rolls 28, 30, 32, 34, and with the warp beam 62 being braked at its own respective predetermined speed-to-time relationship, the deceleration speed-to-time relationships for the driven components being compatibly set to maintain a constant ratio between the respective speeds of the two sets of the draw rolls and a constant ratio between the respective speeds of the draw rolls 36, 38, 40 and the warp beam 62 throughout the entire course of the braking operation. In this manner, all of the driven draw rolls and warp beam come to a standstill at substantially the same time and the tensioning in the filaments F is maintained constant during the course of the braking operation. In FIG. 3, individual braking curves for the draw rolls 28, 30, 32, 34, for the draw rolls 36, 38, 40 and for the warp beam 62 are plotted according to their respective decelerating speeds against elapsed braking time over the course of a braking operation from the initial point of simultaneous actuation of the individual pneumatic brakes 74 to the point of standstill of all driven components. As illustrated, an initial period of time elapses after actuation of the brakes 74 before any deceleration of the driven components actually begins, as of course would be expected, but the valves 80 are designed to react sufficiently rapidly that such period of time is only a matter of milliseconds. Thereafter, the relationship of decelerating speed to elapsed braking time for each driven component is linear, with the respective braking lines for the driven components converging to a common point as they simultaneously decelerate to a standstill, which under the present invention should occur within about one second after braking actuation is initiated.

To accomplish synchronous braking of the independently driven components in this manner, the desired braking curves for the components are initially determined and plotted and then, either by experimentation or mathematical extrapolation, corresponding curves are plotted for the amount of air pressure necessary to be supplied to each pneumatic brake 74 (including any necessary pressure variations) against elapsed braking time over the entire course of the braking operation to match the desired braking curve for each driven component and, for each such pressure curve, a respective curve is then plotted for the level of voltage which must be supplied to each regulator valve 80 (including any voltage changes) against elapsed braking time over the entire course of the braking operation to deliver the necessary air pressure to each pneumatic brake 74 to match its respective pressure curve.

Figure 4:
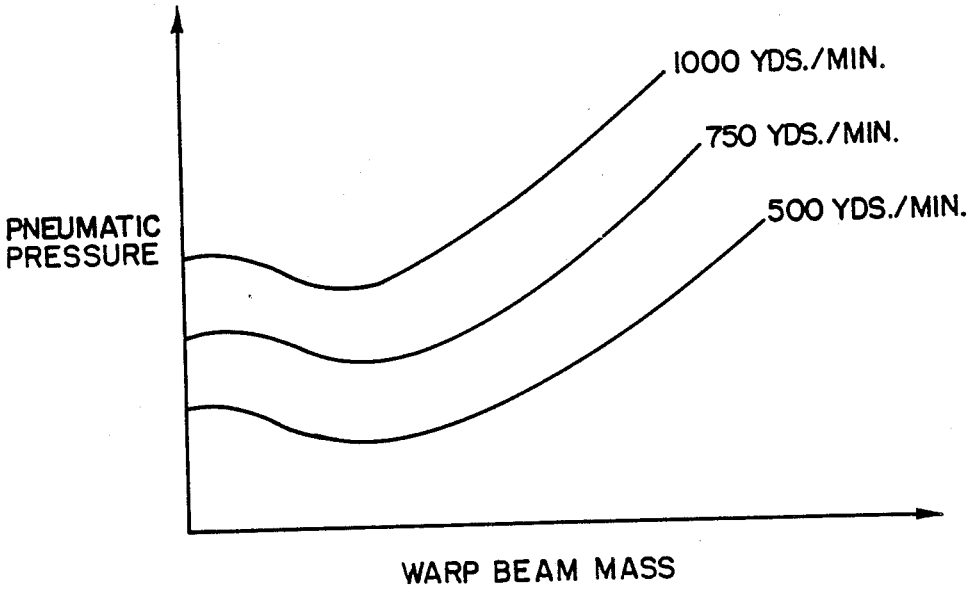
FIG. 4 is another graph illustrating the relationship between fluid braking pressure against the effective warp beam diameter for braking the warp beam of FIG. 2 in accordance with the present invention.

As will be understood, the braking, pressure and voltage curves for each driven component will of course vary as a function of the driven speed of the components at the point in time at which braking is initiated. Accordingly, for each driven component, braking, pressure and voltage curves are developed for each increment of operating speed at which the components may be operated in the normal course of operation of the draw warping system. As aforementioned, the warp beam 62 is driven at a gradually decreasing axial speed over the course of the normal operation of the draw warping system in relation to its increasing effective diameter as the filaments F are progressively wound about the beam, so that the gradually increasing total mass of the warp beam, and the progressively changing inertia thereof, in addition to its gradually decreasing axial speed, affect the braking, pressure and voltage curves for the warp beam 62. Accordingly, the braking, pressure and voltage curves for the warp beam 62 are developed to take into account both its axial speed and its total mass at the point in time at which braking is initiated. This relationship is illustrated in FIG. 4 wherein three curves are plotted illustrating the relationship between the braking air pressure necessary to be supplied to the pneumatic brake associated with the warp beam 62 as the overall mass of the beam increases over the course of the draw warping operation at differing filament traveling speeds of the draw warping system.

The various braking, pressure and voltage curves (or at least the braking and voltage curves) are stored in the memory of the controller 76 for reference purposes in carrying out the braking program of the present invention. Tachometers 82, 84, 86 are respectively connected to each of the drive motors 50, 58, 64 to monitor their operating speeds over the course of the draw warping operation and the controller 76 is electrically connected independently with each tachometer 82, 84, 86 to continuously monitor the sensed operating speeds of the drive motors 50, 58, 64 over the course of the draw warping operation. Each tachometer 82, 84, 86 is also electrically connected to the respective motor drive 51, 59, 65 which controls the associated motor 50, 58, 64 to enable the drives 51, 59, 65 to monitor the sensed operating speeds of the respective drive motors 50, 58, 64 throughout any braking operation. Additionally, an ultrasonic detecting device 88 is arranged within the warp beaming machine 24 to continuously detect the progressively increasing effective diameter of the warp beam 62 as a function of the radial thickness of the filament build-up on the warp beam determined by reflecting ultrasonic sound waves off the central axial winding core of the warp beam 62. The controller 76 is electrically connected to the ultrasonic detecting device 88 to enable the controller 76 to determine the total mass of the warp beam 62 at any given point in the draw warping operation as a function of the effective wound diameter of the beam.

The operation of the braking apparatus 72 of the present invention may thus be understood. The controller 76 is operatively connected with a stop motion of the draw warping system, only representatively indicated at 90, to enable the controller 76 to recognize any actuation of the stop motion 90, e.g., upon a breakage of, or other substantial loss of tension in, one or more of the filaments F, indicating the necessity for stopping operation of the draw warping system. According to the braking program stored within and controlling operation of the controller 76, upon actuation of the stop motion 90, the controller 76 immediately senses the operating speeds of the drive motors 50, 58, 64 as determined by the tachometers 82, 84, 86 and also the effective wound diameter of the warp beam 62 as determined by the ultrasonic detecting device 88 and the controller 76, in turn, immediately supplies independently to each of the regulator valves 80 a respective amount of operating voltage as determined by the braking, pressure and voltage curves stored within the controller 76 in response to the speed and diameter inputs received by the controller 76 from the tachometers 82, 84, 86 and the ultrasonic detecting device 88, so that, in turn, pressurized air from the centralized air source 78 is independently supplied simultaneously to each pneumatic brake 74 at the respective pressure level necessary to exert a braking force on the associated driven component for braking it in accordance with the applicable braking curve. As the braking operation progresses, the controller 76 continues to independently control the amount of voltage supplied to each regulator valve 80 to follow the applicable voltage, pressure and braking curves for each driven member. As will be understood, since the draw rolls 29, 30, 32, 34 are constrained by their common drive belt 42 to rotate in synchronism, such draw rolls will naturally tend to maintain the same decelerating surface speed as braking progresses, thereby automatically correcting any relatively minor deviations in any of the draw rolls 28, 30, 32, 34 from their intended braking curves. Likewise, the commonly driven draw rolls 36, 38, 40, will tend to maintain the identical surface speed over the course for braking.

Upon initiation of a braking operation, the controller 76 also immediately communicates to each motor drive 51, 59, 65 the applicable predetermined desired braking curve for the respective driven components associated with the motor drives. Each motor drive 51, 59, 65 monitors the inputs from its associated tachometer 82, 84, 86, respectively, over the entire course of the braking operation to compare the actual speeds of the drive motors 50, 58, 64 against the respective desired braking curves for their driven components. Since each motor drive 51, 59, 65 is connected independently with the respective drive motors 50, 58, 64, the motor drives 51, 59, 65 are enabled to independently actuate either dynamic braking or driving of any one or more of the motors. Thus, according to an auxiliary routine of the braking program of the present invention, each individual motor drive 51, 59, 65 actuates dynamic braking of its associated drive motor 50, 58, 64 whenever its detected actual speed indicates an upward deviation of its driven component or components from the predetermined braking curve (i.e. a greater speed of the driven component(s) than intended at the prevailing point in elapsed braking time). Likewise, each motor drive 51, 59, 65 actuates driving of its associated drive motor 50, 58, 64 whenever its detected actual speed indicates a downward deviation of its driven component or components from the respective predetermined braking curve (i.e. a lesser than desired speed of the driven component(s) at the prevailing point in elapsed braking time). In this manner, the braking program serves to independently correct for deviations of any one or more of the driven components from their respective predetermined braking curves to insure that the rates of deceleration of the driven components are maintained in synchronism with one another at the predetermined desired speed ratios therebetween. Under ideal optimal circumstances, the auxiliary control of dynamic braking or driving of the motors 50, 58, 64 will be unnecessary since the pneumatic brakes 74 should control braking of the driven components in conformity to their respective predetermined braking curves. However, wear of the drive components over time as well as other factors may produce deviations in the desired braking operation of the pneumatic braking system and, accordingly, the auxiliary routine of the braking programs provides for correction under such circumstances.

As will be readily recognized, this braking apparatus of the present invention provides distinct advantages and improvements over known braking arrangements utilized in conventional draw warping systems. The present braking apparatus is markedly simplified over braking arrangements relying on mechanical gearing for synchronizing simultaneous braking of plural driven components and permits substantially more rapid braking than conventional dynamic braking systems without significant restriction on the normal operating speeds of the draw warping system. As aforementioned, the braking apparatus of the present invention is designed to be capable of braking the disclosed draw warping system from a normal operating speed transporting the filaments F up to 1,000 yards per minute to a complete standstill within the span of one second of braking time. Further, the provision of the braking program of the present invention to provide primary control of braking of the driven components through regulation of the individual pneumatic valves and brakes according to programmed braking, pressure and voltage curves and auxiliary correction of deviations through dynamic braking and driven operation of the drive motors, provide a substantially higher level of operational reliability than conventional braking systems.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile draw warping system having a first set up upstream guide rolls driven by a common first drive means and a second set of downstream guide rolls driven by a common second drive means at a greater surface speed than said first set of rolls for drawing a plurality of synthetic continuous filaments traveling peripherally in sequence over said rolls, apparatus for controlled braking of said first and second sets of rolls, said apparatus comprising:

(a) a plurality of fluid actuated braking means each respectively associated with one of said rolls, (b) a plurality of adjustable valve means each respectively associated with one of said braking means for individually supplying a pressurized operating fluid to each said braking means at independently selectively variable pressures for generation of a correspondingly variable braking force by each said braking means, (c) first means for detecting the common speed of said first set of rolls, (d) second means for detecting the common speed of said second set of rolls, and (e) braking program means including:

(i) primary control means for individually controlling adjustment of each said valve means for controlling the pressure at which the pressurized operating fluid is supplied respectively to each said braking means for individually controlling deceleration of each said roll of said first set in a common predetermined relationship of decreasing roll speed to elapsed time of actuation of said braking means and for individually controlling deceleration of each said roll of said second set in another common predetermined relationship of decreasing roll speed to elapsed time of actuation of said braking means related to said common relationship of said first set of rolls for maintaining a predetermined ratio between the common speed of said first set of rolls and the common speed of said second set of rolls during braking, and (ii) auxiliary control means independently responsive to each said first and second detecting means for independently controlling dynamic braking and driving of said first and second drive means in conjunction with said plurality of fluid-actuated braking means for independently correcting deviations in the detected common speeds of said first and second sets of rolls from their respective said common speed-to-time relationships.

2. Apparatus for controlled braking of guide rolls in a textile draw warping system according to claim 1 and characterized further in that said draw warping system comprises a warp beaming machine having a warp beam driven by a third drive means for winding said plural filaments about said beam, said braking apparatus further comprising another fluid actuated braking means associated with said warp beam, another adjustable valve means associated with said another braking means for supplying pressurized operating fluid to said another braking means at a selectively variable pressure for generating a correspondingly variable braking force by said another braking means, third means for detecting the speed of said warp beam, and means for detecting the wound diameter of filaments on said warp beam, said primary control means being adapted for independently controlling adjustment of said another valve means for controlling the pressure at which the pressurized operating fluid is supplied to said another braking means for controlling deceleration of said warp beam in a predetermined relationship of decreasing speed of said warp beam to elapsed time of actuation of said another braking means related to said common speed-to-time relationship of said second set of rolls for maintaining a predetermined ratio between the common speed of said second set of rolls and the speed of said warp beam during braking, said primary control means being responsive to said diameter detecting means for adjusting said predetermined speed-to-time relationship of said warp beam according to the total mass of said warp beam and filaments wound thereon as a function of the detected wound diameter of filaments on said warp beam, said auxiliary control means being independently responsive to said third detecting means for independently controlling dynamic braking and driving of said third drive means in conjunction with said another fluid-actuated braking means for independently correcting deviations in the detected speed of said warp beam from its said predetermined speed-to-time relationship.

3. Apparatus for controlled braking of guide rolls in a textile draw warping system according to claim 2 and characterized further in that said braking program means includes means for independently adjusting each of said predetermined speed-to-time relationships for said first said of rolls, said second set of rolls and said warp beam, respectively, as a function of the respective drive speeds thereof detected by said first, second and third detecting means, respectively, prior to actuation of their said braking means.

4. Apparatus for controlled braking of guide rolls in a textile draw warping system according to claim 2 and characterized further in that said diameter detecting means comprises means for ultrasonic measuring of the radial depth of yarn windings on said warp beam.

5. Apparatus for controlled braking of guide rolls in a textile draw warping system according to claim 2 and characterized further in that each of said first, second and third detecting means comprises a tachometer associated with the respective said first, second and third drive means.

6. Apparatus for controlled braking of guide rolls in a textile draw warping system according to claim 2 and characterized further in that said braking program means comprises a programmable logic controller.

7. Apparatus for controlled braking of guide rolls in a textile draw warping system according to claim 2 and characterized further in that each said valve means is electrically adjustable in relation to varying of an operating voltage supply thereto.

8. Apparatus for controlled braking of guide rolls in a textile draw warping system according to claim 7 and characterized further in that said braking means is adapted for actuation by pressurized air.

* * * * *

UNITED STATES PATENT AND TRADEMARK OFFICE

CERTIFICATE OF CORRECTION

PATENT NO. : 4,916,783

DATED : April 17, 1990

INVENTOR(S) : John F. Hagewood et al

It is certified that error appears in the above-identified patent and that said Letters Patent is hereby corrected as shown below:

Column 1, Line 44, reads "side-by side" but should read -- side-by-side --.

Column 2, Line 5, reads "braking," but should read -- braking. --.

Column 2, Line 41, reads "per be" but should read -- per se --.

Column 4, Line 9, reads "." but should read -- ; --.

Column 4, Line 61, after "Apparatus," add -- " --.

Column 4, Line 62, after "4,852,225" delete -- " --.

Column 5, Line 18, reads "extend" but should read -- extent --.

Column 5, Line 35, reads "rolls, 36" but should read -- rolls 36 --.

Column 6, Line 3, reads "become" but should read -- becomes --.

Column 6, Line 8, reads "rolls, 36" but should read -- rolls 36 --.

Column 6, Line 8, reads "takeup" but should read -- take-up --.

Column 6, Line 48, reads "valve" but should read -- valves --.

Column 9, Line 8, reads "rolls 29" but should read -- rolls 28 --.

Column 10, Lines 17-18, reads "provide" but should read -- provides --.

UNITED STATES PATENT AND TRADEMARK OFFICE

CERTIFICATE OF CORRECTION

PATENT NO. : 4,916,783

DATED : April 17, 1990

INVENTOR(S) : John F. Hagewood et al

It is certified that error appears in the above-identified patent and that said Letters Patent is hereby corrected as shown below:

Column 10, Line 43, reads "up upstream" but should read -- of upstream --.

Column 12, Line 20, reads "first said" but should read -- first set --.

Signed and Sealed this

Sixth Day of October, 1992

*Attest:*

DOUGLAS B. COMER

*Attesting Officer*

*Acting Commissioner of Patents and Trademarks*